US010161029B2

(12) United States Patent
Lien

(10) Patent No.: US 10,161,029 B2
(45) Date of Patent: Dec. 25, 2018

(54) MANUFACTURING PROCESS OF HEAT-RESISTING GLASS OR ENAMEL COATING ON A THERMALLY INSULATED CONTAINER CHAMBER

(71) Applicant: Sohome Houseware (Nanjing) Co., Ltd., Nanjing (CN)

(72) Inventor: Victor Tsang-Tong Lien, Nanjing (CN)

(73) Assignee: Sohome Houseware (Nanjing) Co., Ltd., Nanjing (CN)

( * ) Notice: Subject to any disclaimer, the term of this patent is extended or adjusted under 35 U.S.C. 154(b) by 0 days.

(21) Appl. No.: 15/189,143

(22) Filed: Jun. 22, 2016

(65) Prior Publication Data

US 2017/0260617 A1 Sep. 14, 2017

(30) Foreign Application Priority Data

Mar. 9, 2016 (CN) ..... 2016 1 0133098

(51) Int. Cl.

| | |
|---|---|
| ***B05D 3/12*** | (2006.01) |
| ***C23C 4/18*** | (2006.01) |
| ***B24C 1/06*** | (2006.01) |
| ***B65D 81/38*** | (2006.01) |
| ***C23D 5/02*** | (2006.01) |
| ***C23D 7/00*** | (2006.01) |

(52) U.S. Cl.
CPC ..... *C23C 4/18* (2013.01); *B24C 1/06* (2013.01); *B65D 81/38* (2013.01); *C23D 5/02* (2013.01); *C23D 7/00* (2013.01)

(58) Field of Classification Search
CPC .... B24C 1/06; C23C 4/18; C23C 4/04; C23C 6/00
See application file for complete search history.

(56) References Cited

U.S. PATENT DOCUMENTS

| | | | | |
|---|---|---|---|---|
| 4,683,168 | A * | 7/1987 | Hares | C03C 15/00 427/309 |
| 2005/0224417 | A1* | 10/2005 | Wien | C02F 1/004 210/681 |
| 2010/0162662 | A1* | 7/2010 | Iwashita | B65B 55/10 53/426 |
| 2015/0158657 | A1* | 6/2015 | Olson | B65D 81/3841 220/592.27 |

FOREIGN PATENT DOCUMENTS

| | | | |
|---|---|---|---|
| CN | 101935166 | A | 1/2011 |
| CN | 102335650 | A | 2/2012 |
| CN | 203848507 | U | 9/2014 |
| CN | 105011678 | A | 11/2015 |
| CN | 105506627 | A | 4/2016 |
| KR | 10-1283762 | B1 | 7/2013 |

OTHER PUBLICATIONS

Faust, W. D. 2009. Enamels, Porcelain Or Vitreous. Kirk-Othmer Encyclopedia of Chemical Technology. 1-32.*
First Office Action in counterpart Chinese application 201610133098.7.
Second Office Action in counterpart Chinese application 201610133098.7.

* cited by examiner

*Primary Examiner* — Kelly M Gambetta
(74) *Attorney, Agent, or Firm* — Westbridge IP LLC

(57) ABSTRACT

A manufacturing process of a heat-resisting glass or enamel coating of a thermally insulated container chamber is described. The process comprises selecting a thermally insulated metal container body, and performing sand blasting to a chamber surface of the body such that the chamber surface becomes a rough surface. The process comprises spraying a glass or enamel glazing material on the rough surface of the body and drying the glazing material on the rough surface. The process comprises placing a dried body on a bracket and sintering the dried body. After sintering is performed, the process comprises removing the body from the bracket. Using this disclosure the chemical properties of the glass coating or enamel coating are relatively stable, so corrosion will not occur. Because the thermal expansion and cold contraction are relatively small, the coating is suitable for manufacturing thermally insulated containers such as thermally insulated cups.

16 Claims, No Drawings

MANUFACTURING PROCESS OF HEAT-RESISTING GLASS OR ENAMEL COATING ON A THERMALLY INSULATED CONTAINER CHAMBER

CROSS-REFERENCE TO RELATED APPLICATION

This application claims priority to Chinese Patent Application 201610133098.7 filed on Mar. 9, 2016.

TECHNICAL FIELD

This disclosure relates to the field of manufacture of thermally insulated container chambers, and particularly to a manufacturing process of a heat-resisting glass or enamel coating on a thermally insulated container chamber.

BACKGROUND

Normally, when people travel around or go outside in winter, they usually carry thermally insulated cups for carrying drinking water. Currently, most of thermally insulated cups are made of plastic materials or stainless steel alloy.

Plastic materials are cheap and light in weight. However, when such materials encounter with hot water, some unhealthy substances can be easily generated which causes the safety property of thermally insulated cups made of plastic materials not good. Further, the thermal expansion and cold contraction degree of plastics is relative higher which will cause the sealing property of thermally insulated cups made of plastic material decreased after long-term use.

Shortcoming of thermally insulated cups made of stainless steel alloy is that, when carbonated drinks, alkali drinks or tea is put in this type of cups, acids or alkalis in such drinks may corrode stainless steel alloy and metal ions can be generated easily. After long-term use, thermally insulated cups made of stainless steel alloy can easily generate a taste of rust, which will produce negative effects to users.

SUMMARY

To solve one or more of the above problems, the present disclosure provides a manufacturing process of a heat-resisting glass or enamel coating on a thermally insulated container chamber.

According to one aspect of the present disclosure, it provides a manufacturing process of a heat-resisting glass or enamel coating on a thermally insulated container chamber, which comprises selecting a thermally insulated container body made of metal and performing sandblasting to inner chamber surface of the thermally insulated metal container body such that the inner chamber surface becomes a coarse surface; spraying a glass or enamel glazing material onto the coarse surface of the thermally insulated metal container body; drying the glazing material on the coarse surface; placing a dried thermally insulated metal container body on a bracket; sintering the dried thermally insulated metal container body; and after sintering is performed, removing the thermally insulated metal container body from the bracket to obtain a finished product.

The present disclosure can produce the following advantageous effects: 1) during manufacturing process of the thermally insulated container, after a glass coating or enamel coating is formed onto the inner chamber surface of the thermally insulated container, it will not have a corrosion problem because the chemical properties of the glass coating or enamel coating are relatively stable; and 2) because the thermal expansion and cold contraction degree of the glass coating or enamel coating is relatively small, the glass coating or enamel coating is suitable for manufacture of thermally insulated containers such as thermally insulated cups.

In some embodiments, in above paragraph, white corundum with 46-60 meshes is used as a material for performing sandblasting and sandblasting operation is performed under an air pressure ranging of 6-8 MPa. In the sandblasting operation, the thermally insulated metal container body is fixed with its opening end facing downwards and then rotated slowly for 60-120 seconds. After the sandblasting, roughness of the inner chamber surface of the thermally insulated metal container body is about Ra3.2 μm to Ra6.3 μm. In this manner, the following advantageous effects can be achieved: 1) because white corundum is hard, it is a good material for sandblasting; 2) during sandblasting, the thermally insulated metal container body is kept facing downwards which can prevent dusts from accumulating inside the body chamber and the dusts generated can also directly fall off the container body; and 3) because the surface roughness of the chamber directly affects the surface adhesion force of the glazing material, when the inner chamber surface is rough, the surface adhesion force is relatively higher. The denser the pits caused by the sandblasting are, the better the adhesion effect is. Some experiments show that the surface adhesion force of the glazing material is better when the surface roughness of the metal is ranging Ra3.2 μm to Ra6.3 μm.

In some embodiments, sandblasting the inner chamber surface further comprises shielding non-effective surfaces of the thermally insulated metal container body by a barrier when performing sandblasting. Such advantageous effect can be achieved that after shielding the non-effective surface, pits on unnecessary areas of the surfaces can be prevented.

In some embodiments, specific gravity of the glazing material being used in the spraying operation ranges from 1.65 to 1.70 (namely, mass ratio of the glazing material to water is between 1.65 and 1.70). Adhesion amount of the glazing material adhered to the inner chamber surface ranges from 120 to 130 g/m$^2$ and thickness of the glazing material in the spraying is kept at 180 μm. The advantageous effect of such is that good glazing effect can be ensured.

In some embodiments, the drying temperature ranges from 200° C. to 250° C. and a chain speed of the thermally insulated metal container body during the drying process is between 1.5 and 3 meter/minute. The chain speed refers to moving speed of the thermally insulated metal container body during the drying process. The advantageous effect is that such conditions can ensure a good drying effect and shorten the drying time. If the temperature or the chain speed is too high, the thermally insulated metal container body may be damaged or suffer from an uneven drying.

In some embodiments, before placing the dried container, body on a bracket, the manufacturing process further comprises cleaning excessive glazing material on the thermally insulated metal container body with a wiping object. After placing the thermally insulated metal container body on the bracket, the thermally insulated metal container body is kept with its opening facing downwards. This configuration is advantageous on that: 1) usually sponge with little clean water can be used for the cleaning; and 2) because the opening of the dried thermally insulated metal container body is kept facing downwards, the glazing material can be prevented from flowing back to the inside of the opening of the dried thermally insulated metal container body due to gravity and thus local clustering of the glazing material can be prevented.

In some embodiments, the sintering temperature ranges from 780° C. to 840° C. and the chain speed is 3 meters per minute. The advantageous effect of such is that a good sintering effect can be ensured.

In some embodiments, the thermally insulated metal container is a thermally insulated vessel.

In some embodiments, the thermally insulated metal container is a thermally insulated cup.

The present disclosure also covers a thermally insulated cup manufactured according to the above manufacturing process.

The present disclosure can have the following advantageous effects:

1) with the thermally insulated cup manufactured according to the above manufacturing process, a glass coating or enamel coating is formed on the inner chamber surface of the thermally insulated cup. Because chemical properties of the glass coating or enamel coating are relatively stable, corrosion is not likely to occur. Thermal expansion and cold contraction degree of the glass coating or enamel coating are relatively small;

2) When the thermally insulated cup of the present disclosure encounters with hot water, unhealthy substances will not be generated and thus the safety property of thermally insulated cup is good. In addition, thermal expansion and cold contraction degree of the glass coating or enamel coating are relatively small so that the sealing property of the thermally insulated cup of this disclosure will not decrease after long-term use;

3) When carbonated drinks, alkali drinks or tea is/are contained in the thermally insulated cup of the present disclosure, acids or alkalis in such drinks would not corrode the glass coating or enamel coating and hence no metal ions will be generated. After long-term use, the thermally insulated cup of the present disclosure will not generate a taste of rust which can bring good user experience.

DETAILED DESCRIPTION

The disclosure discloses a manufacturing process of a heat-resisting glass or enamel coating for chamber of a thermally insulated container. The manufacturing process comprises the steps of: selecting a thermally insulated container body made of metal and performing sandblasting to inner chamber surface of the thermally insulated metal container body such that the inner chamber surface becomes a coarse surface; spraying a glass or enamel glazing material onto the coarse surface of the thermally insulated metal container body; drying the glazing material on the coarse surface; placing a dried thermally insulated metal container body on a bracket; sintering the dried thermally insulated metal container body; and after sintering is performed, removing the thermally insulated metal container body from the bracket to obtain a finished product.

During manufacturing process of the thermally insulated container according to the present disclosure, after a glass coating or enamel coating is formed on the inner chamber surface of the thermally insulated container body, because chemical properties of the glass coating or enamel coating are relatively stable, corrosion is prevented from occur. Meanwhile, because thermal expansion and cold contraction degree of the glass coating or enamel coating is relatively small, the glass coating or enamel coating is suitable for manufacture of thermally insulated containers such as thermally insulated cups.

Usually, the container body metal may be white corundum with 46-60 meshes is used as a material for performing sandblasting and sandblasting operation is performed under an air pressure ranging from 6 MPa to 8 MPa. During sandblasting, the thermally insulated metal container body is fixed with its opening end facing downwards and then rotated slowly for 60-120 seconds. After sandblasting, roughness of the inner chamber surface of the thermally insulated metal container body is about Ra3.2 μm to Ra6.3 μm. Because white corundum is hard, it is a good material for sandblasting. During sandblasting, the thermally insulated metal container body is kept facing downwards which can prevent dusts from accumulating inside the body chamber and the dusts generated can also directly fall off the container body. Because the surface roughness of the chamber directly affects the surface adhesion force of the glazing material, when the inner chamber surface is rough, the surface adhesion force is relatively higher. The denser the pits caused by the sandblasting are, the better the adhesion effect is. Some experiments show that the surface adhesion force of the glazing material is better when the surface roughness of the metal is ranging Ra3.2 μm to Ra6.3 μm.

In addition, during sandblasting, the non-effective surface of the thermally insulated metal container body by a barrier is shielded when performing sandblasting. This is advantageous on that, after shielding the non-effective surface, pits on unnecessary areas of the surfaces can be prevented.

The specific gravity of the glazing material being used in the spraying operation ranges from 1.65 to 1.70 (namely, mass ratio of the glazing material to water is between 1.65 and 1.70). Adhesion amount of the glazing material adhered to the inner chamber surface ranges from 120 to 130 $g/m^2$ and thickness of the glazing material is maintained at 180 μm. The advantageous effect is that a good glazing effect can be ensured.

During the drying process, the drying temperature ranges from 200° C.-250° C. and a chain speed of the thermally insulated metal container body is between 1.5 and 3 meter/minute. The chain speed refers to moving speed of the thermally insulated metal container body during the drying process. The advantageous effect is that a good drying effect can be ensured and the drying time can be shortened. If the temperature or the chain speed is too high, the thermally insulated metal container body may be damaged or suffer from an uneven drying.

Before placing the dried container body on a bracket, the manufacturing process further comprises cleaning excessive glazing material on the thermally insulated metal container body by using a wiping object. After placing the thermally insulated container body on the bracket, the container body is kept with its opening end facing downwards. With this configuration, the following advantageous effects can be produced: 1) usually, sponge with little clean water can be used for the cleaning; and 2) because the opening of the dried thermally insulated metal container body is kept facing downwards, the glazing material can be prevented from flowing back to the inside of the opening of the dried thermally insulated metal container body due to gravity and thus local clustering of the glazing material can be prevented.

During sintering, the sintering temperature is adopted as 780-840° C. and the chain speed is chosen as 3 meters per minute. This can ensure a good sintering effect.

The present disclosure also relates to a thermally insulated vessel manufactured according to the above manufacturing process. Specifically, the thermally insulated vessel is a thermally insulated cup.

With the thermally insulated cup manufactured according to the above manufacturing process, a glass coating or enamel coating is formed onto the chamber surface of the thermally insulated cup. Because chemical properties of the glass coating or enamel coating are relatively stable, corrosion will not occur. In addition, thermal expansion and cold contraction degree of the glass coating or enamel coating are also relatively lower.

When the thermally insulated cup of the present disclosure encounters with hot water, no unhealthy substances will be generated so that safety property of the thermally insulated cup is good. In addition, thermal expansion and cold contraction degree of the glass coating or enamel coating are relatively smaller, so sealing property of the thermally insulated cup of this disclosure will not degrade after long-term use.

When carbonated drinks, alkali drinks or tea is/are contained in the thermally insulated cup of the present disclosure, acids or alkalis in such drinks cannot corrode the glass coating or enamel coating and no metal ions will be generated. After long-term use, the thermally insulated cup according to the present disclosure will not generate a taste of rust which can bring good user experience.

The above are only some embodiments of the present disclosure. Various modifications and improvements can be made by those skilled in the art without departing from the inventive concept of the present disclosure as set forth in the appended claims.

The invention claimed is:

1. A manufacturing process of a heat-resisting glass or enamel coating on a thermally insulated container chamber, comprising:

selecting a thermally insulated container body made of metal and performing sandblasting to an inner chamber surface of the thermally insulated metal container body such that the inner chamber surface becomes a coarse surface with a roughness from Ra3.2 μm to Ra6.3 μm;

spraying a glass or enamel glazing material onto the coarse surface of the thermally insulated metal container body;

drying the glazing material on the coarse surface;

cleaning excessive glazing material on the thermally insulated metal container body with a wiping object;

placing a dried thermally insulated metal container body on a bracket with an opening end of the body facing downwards;

sintering the dried thermally insulated metal container body; and after sintering is completed, removing the thermally insulated metal container body from the bracket to obtain a finished product.

2. The manufacturing process of claim 1, during selecting, using white corundum with 46-60 meshes as a material for performing the sandblasting under an air pressure ranging from 6-8 MPa; and during sandblasting, the thermally insulated metal container body is fixed with the opening end facing downwards and then rotated slowly for 60-120 seconds.

3. The manufacturing process of claim 1, further comprising shielding a non-effective surface of the thermally insulated metal container body by a barrier when performing the sandblasting.

4. A manufacturing process of a heat-resisting glass or enamel coating on a thermally insulated container chamber, comprising:

selecting a thermally insulated container body made of metal and performing sandblasting to inner chamber surface of the thermally insulated metal container body such that the inner chamber surface becomes a coarse surface;

spraying a glass or enamel glazing material onto the coarse surface of the thermally insulated metal container body, the glazing material having a specific gravity that ranges from 1.65 to 1.70, adhesion amount of the glazing material ranges from 120 to 130 grams per square meter ($g/m^2$), and thickness of the glazing material is maintained at 180 μm;

drying the glazing material on the coarse surface;

cleaning excessive glazing material on the thermally insulated metal container body with a wiping object;

placing a dried thermally insulated metal container body on a bracket with an opening end of the body facing downwards;

sintering the dried thermally insulated metal container body; and after sintering is completed, removing the thermally insulated metal container body from the bracket to obtain a finished product.

5. The manufacturing process of claim 1, wherein the glaze material drying temperature ranges from 200 to 250° C. and a chain speed of the thermally insulated metal container body is between 1.5 and 3 meter/minute.

6. The manufacturing process of claim 1, wherein sintering is performed at a temperature ranging from 780° C. to 840° C. and a chain speed is 3 meters per minute.

7. The manufacturing process of claim 1, wherein the thermally insulated metal container is a thermally insulated vessel.

8. The manufacturing process of claim 1, wherein the thermally insulated metal container is a thermally insulated cup.

9. The manufacturing process of claim 4, during selecting, using white corundum with 46-60 meshes as a material for performing the sandblasting under an air pressure ranging from 6-8 MPa; and during sandblasting, the thermally insulated metal container body is fixed with the opening end facing downwards and then rotated slowly for 60-120 seconds.

10. The manufacturing process of claim 4, further comprising shielding a noneffective surface of the thermally insulated metal container body by a barrier when performing the sandblasting.

11. The manufacturing process of claim 4, wherein the glaze material drying temperature ranges from 200 to 250° C. and a chain speed of the thermally insulated metal container body is between 1.5 and 3 meter/minute.

12. The manufacturing process of claim 4, wherein sintering is performed at a temperature ranging from 780° C. to 840° C. and a chain speed of 3 meters per minute.

13. The manufacturing process of claim 4, wherein the thermally insulated metal container is a thermally insulated vessel.

14. The manufacturing process of claim 4, wherein the thermally insulated metal container is a thermally insulated cup.

15. A manufacturing process of a heat-resisting glass or enamel coating on a thermally insulated container chamber, comprising:

selecting a thermally insulated container body made of metal and performing sandblasting using white corundum with 46-60 meshes under an air pressure ranging from 6-8 MPa to an inner chamber surface of the thermally insulated metal container such that the inner chamber surface becomes a coarse surface, during sandblasting, the thermally insulated metal container body is fixed with an opening end facing downwards and then rotated slowly for 60-120 seconds;

spraying a glass or enamel glazing material onto the coarse surface of the thermally insulated metal container body, the glazing material having a specific gravity that ranges from 1.65 to 1.70, adhesion amount of the glazing material ranges from 120 to 130 grams per square meter ($g/m^2$), and thickness of the glazing material is maintained at 180 μm;

drying the glazing material on the coarse surface;

cleaning excessive glazing material on the thermally insulated metal container body with a wiping object;

placing a dried thermally insulated metal container body on a bracket with an opening end of the body facing downwards;

sintering the dried thermally insulated metal container body; and after sintering is completed, removing the thermally insulated metal container body from the bracket to obtain a finished product.

16. The manufacturing process of claim 15, further comprising sandblasting the inner chamber surface of the thermally insulated metal container body such that the inner chamber surface becomes a coarse surface with a roughness from Ra3.2 μm to Ra6.3 μm.

* * * * *